United States Patent [19]

Yanagisawa

[11] 4,380,558

[45] Apr. 19, 1983

[54] PROCESS FOR MANUFACTURING A PROTECTIVE POLYSILICATE LAYER OF A RECORD MEMBER BY A LASER BEAM AND A MAGNETIC RECORD MEMBER SUITABLY MANUFACTURED THEREBY

[75] Inventor: Masahiro Yanagisawa, Tokyo, Japan

[73] Assignee: Nippon Electric Co., Ltd., Tokyo, Japan

[21] Appl. No.: 192,566

[22] Filed: Sep. 30, 1980

[30] Foreign Application Priority Data

| | | | |
|---|---|---|---|
| Oct. 2, 1979 | [JP] | Japan | 54-127626 |
| Dec. 20, 1979 | [JP] | Japan | 54-165933 |
| Dec. 20, 1979 | [JP] | Japan | 54-165934 |
| Dec. 24, 1979 | [JP] | Japan | 54-167848 |

[51] Int. Cl.[3] ..... B05D 3/06

[52] U.S. Cl. ..... 427/53.1; 204/159.13; 427/129; 427/130; 427/131; 427/132; 428/695; 428/900

[58] Field of Search ..... 428/64, 65, 674, 695, 428/900, 850; 427/53.1, 128, 129, 131, 132, 130; 204/159.13; 346/135.1; 219/121 L, 14 LM; 360/134, 135, 136

[56] References Cited

U.S. PATENT DOCUMENTS

| | | | |
|---|---|---|---|
| 3,743,777 | 7/1973 | Hanus et al. | 427/53.1 |
| 4,069,360 | 1/1978 | Ajanagisawce et al. | 128/447 |
| 4,162,350 | 7/1979 | Ajanagisawce et al. | 427/131 |
| 4,188,433 | 2/1980 | Dijkstra et al. | 428/332 |
| 4,309,482 | 1/1982 | Suzuki et al. | 428/695 |

*Primary Examiner*—Stanley S. Silverman

*Attorney, Agent, or Firm*—Sughrue, Mion, Zinn, Macpeak & Seas

[57] ABSTRACT

A protective polysilicate layer for a thin magnetic metal member, such as a magnetic disk or a magnetic drum, is manufactured by pre-baking a layer of a solution of tetrahydroxysilane, for example, at 200° C. for one hour. Condensation polymerization of the tetrahydroxysilane is subsequently promoted by irradiating the pre-baked layer by a laser beam having a wavelength between 4 and 50 microns, preferably between 9 and 11 microns, such as a carbon dioxide laser beam. The magnetic metal film reflects the laser beam. Preferably, a thin layer, such as less than 0.05 micron thick, of a material capable of reflecting the laser beam, is formed on the magnetic metal film before application of the tetrahydroxysilane solution. The irradiation may be carried out either simply directly or through a laser beam collector. Alternatively, a pair of pre-baked layers may simultaneously be treated by juxtaposing another half-finished magnetic record member and causing the laser beam to be repeatedly reflected by the magnetic metal films and/or the reflective layers. A reflector may be substituted for the other half-finished magnetic record member.

13 Claims, 9 Drawing Figures

FIG. 1
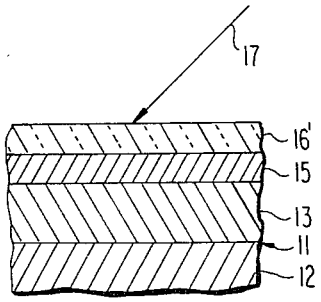
FIG. 2
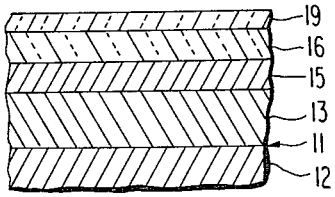
FIG. 3
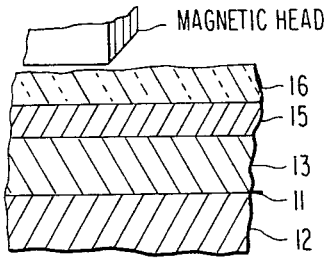
FIG. 4
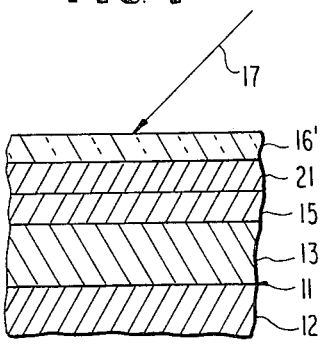
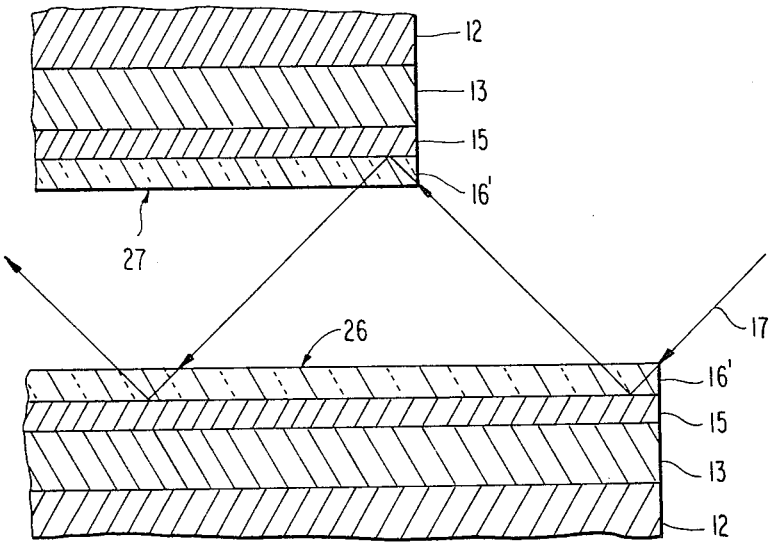
FIG. 5

PROCESS FOR MANUFACTURING A PROTECTIVE POLYSILICATE LAYER OF A RECORD MEMBER BY A LASER BEAM AND A MAGNETIC RECORD MEMBER SUITABLY MANUFACTURED THEREBY

BACKGROUND OF THE INVENTION

This invention relates to a process for manufacturing a magnetic record member, such as a magnetic disk or a magnetic drum, and to a magnetic record member which is of the structure suitably manufactured by the process.

It is usual that a magnetic record member comprises a substrate of at least one non-magnetic material and a thin film of a magnetic metal thereon. Such a magnetic record member is used in a magnetic recording device, which is used in, among others, a data processing system. The magnetic recording device comprises a magnetic head, as called herein, relative to which the magnetic record member is movable. Responsive to electrical signals, the head records the electrical signals as magnetization in the magnetic metal film along a track. The magnetic metal film keeps the magnetization as records of the electrical signals. The head is used also in reproducing the electrical signals from the records and in erasing the records. Such function of a magnetic recording device will be referred to herein as "operation" of the device. When a plurality of magnetic heads are used, the operation is carried out along a plurality of tracks, respectively, which are concentric in a magnetic disk and either parallel or helical in a magnetic drum.

For a magnetic record device in which the magnetic record member is moved relative to the head or heads at a high speed, it is preferred to resort to the contact-start-stop method (hereafter abbreviated to CSS method), as called in the art. According to the CSS method, the head is in contact with the magnetic record member at rest before start of operation of the device. During operation, a layer of air is formed as a result of the relative movement between the head and the magnetic record member. On carrying out stop of the operation, the head is brought into contact with the magnetic record member so as to rest in contact therewith. During the high speed relative movement, the air layer serves to avoid friction between the head and the magnetic record member.

Even with the CSS method, it is inevitable that the head is in frictional contact with the magnetic record member at the start and stop and also in some unexpected cases. The friction results in mechanical wear of the head and the magnetic record member and goes worse, as the case may be, to damage either or both. The magnetic metal film is subject to chemical attack by a humid atmosphere and the like if left exposed to the environment. It is therefore important to form a protective layer on the magnetic metal film for protecting the latter against the mechanical wear and/or damage and the chemical attack. It is preferable that the protective layer could further serve to protect the head. In addition, the magnetic record member is subject to scratch by a tip or an edge of something hard. It is therefore desirable that the protective layer should protect the magnetic metal film against such scratches.

A magnetic record member comprising a polysilicate film or layer on the magnetic metal film is disclosed in U.S. Pat. No. 4,162,350 issued to Masahiro Yanagisawa, the present applicant, et al and assigned to the present assignee. The polysilicate layer is formed by applying a solution of tetrahydroxysilane onto the magnetic metal film to form a layer of the solution and then baking the layer of solution at a raised temperature during a predetermined interval of time. It is mandatory that the recording and the reproducing characteristics of the magnetic metal film should not be adversely affected during the baking step as a result of deterioration in magnetic properties of the magnetic metal film and undesired magnetization of the substrate. The polysilicate layer serves as an excellent protective layer as discussed in detail in the cited United States patent. It would be more advantageous if the reliability of such a polysilicate layer could further be raised.

SUMMARY OF THE INVENTION

It is therefore a general object of the present invention to provide a process for manufacturing a magnetic record member of the type revealed in U.S. Pat. No. 4,162,350 referred to hereinabove.

It is a specific object of this invention to provide a process of the type described, by which it is possible to raise the reliability of a polysilicate layer used as a protective layer in such a magnetic record member.

It is another specific object of this invention to provide a process of the type described, by which it is possible to raise the productivity of such magnetic record members.

It is still another specific object of this invention to provide a magnetic record member of a structure which is suitably manufactured by a process of the type described.

Generally speaking, a process for manufacturing a magnetic record member of the type revealed in the above-cited United States patent comprises the steps of preparing a substrate of at least one non-magnetic material, forming a film of a magnetic material on the substrate in direct contact therewith, forming a layer of a solution of tetrahydroxysilane on the film, and treating the layer of solution into a layer of polysilicate. The magnetic material should be capable of retaining magnetization as records of electrical signals in the film for reproduction of the electrical signals.

According to the instant invention, the treating step is carried out by the steps of pre-baking the layer of solution at a temperature higher than 100 degrees centigrade to provide a pre-baked layer in a manner such that the magnetic properties of the substrate and the film are not varied to adversely affect the recording and the reproducing characteristics of the film, and of irradiating the pre-baked layer by a laser beam to provide the polysilicate layer. The laser beam should have a wavelength between 4 microns and 50 microns.

As described in the United States patent being referred to, the polysilicate layer includes about 56% by weight of silanol radicals when the layer of solution is baked at 100° C. for eight or more hours. The percentage decreases to about 29% when the baking step is carried out at 200° C. for three or more hours and to about 10% for the baking step at 350° C. for one or more hours. In view of the characteristics which the polysilicate layer should have, the baking step is most preferably carried out at a temperature between 100° C. and 300° C. although the layer of solution can be baked at as high a temperature as 750° C., when the percentage decreases to about 2%. The silanol radicals have an infrared absorption spectrum at a wavelength of 2.9 microns (at a wave number of about 3400 $cm^{-1}$).

It has now been confirmed that the polysilicate well absorbs infrared rays of wavelengths between 4 microns and 50 microns. According to the infrared absorption spectrum analysis, the absorption increases to a considerable extent when the wavelength is between 9 microns and 11 microns. The polysilicate partly formed during the pre-baking step absorbs the laser beam. As a result, the pre-baked layer is baked to the desired polysilicate layer. The silanol radicals have another absorption spectrum at a wavelength of 10.6 microns. Depending on the wavelength or wavelengths of the laser beam, the silanol radicals are also baked. At any rate, the high energy density of the laser beam renders the polysilicate layer more reliable. Although not yet confirmed by experiments, the above-mentioned percentage might be rendered less than 10% by weight. Furthermore, the high energy density makes it possible to carry throughout the baking step within a very short interval of time to raise the productivity of the magnetic record members. Incidentally, the polysilicate is a heat insulator.

On the other hand, the film of magnetic material well reflects the infrared rays in these wavelength ranges. This serves to effective use of the laser beam energy. In addition, this serves to develop a great temperature difference between the layer being baked and the film of magnetic material, thereby preventing the temperature from being unduly raised both in the film of magnetic material and in the substrate. This serves to keep the magnetic properties of the film and the substrate excellent.

It is therefore more preferred according to this invention that a magnetic record member comprising a substrate of at least one non-magnetic material, a film of a magnetic material directly on the substrate, and a polysilicate layer on the film of magnetic material, should comprise a reflective layer between the film of magnetic material and the polysilicate layer, which reflective layer is capable of reflecting infrared rays having wavelengths at least between 9 microns and 11 microns.

Other features and advantages of a process according to this invention will become clear as the description proceeds.

BRIEF DESCRIPTION OF THE DRAWING

FIG. 1 is a schematic radial sectional view of a portion of a magnetic disk for use in describing a process according to a first embodiment of the present invention;

FIG. 2 is a diagrammatic radial sectional view of a modification of the magnetic disk of the type shown in FIG. 1;

FIG. 3 is a diagrammatic sectional view, taken perpendicular to a radius, of another modification of the magnetic disk of the type illustrated in FIG. 1;

FIG. 4 is a schematic radial sectional view of a portion of a magnetic disk for use in describing a process according to a second embodiment of this invention;

FIG. 5 is a schematic radial sectional view of a pair of magnetic disk portions for use in describing a process according to a third embodiment of this invention;

DESCRIPTION OF THE PREFERRED EMBODIMENTS

Figure 6:
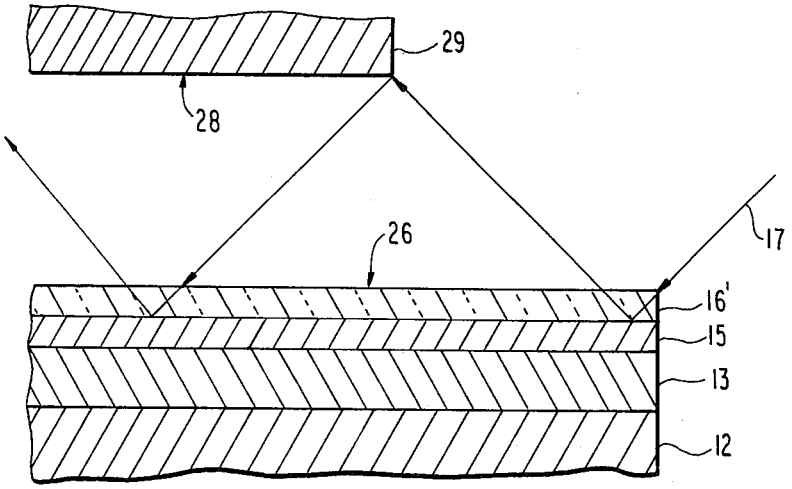
FIG. 6 is a schematic radial sectional view of a portion of a magnetic disk for use in describing a process according to a fourth embodiment of this invention.

Referring to FIG. 1, a magnetic disk of the type disclosed in U.S. Pat. No. 4,162,350 referred to hereinabove, is manufactured in accordance with a process according to a first embodiment of the present invention by preparing at first a substrate 11 of at least one non-magnetic material. The substrate 11 may comprise an alloy disk 12 and an alloy layer 13 thereon. It is already known that an aluminium alloy is preferred as the material of the disk 12 because of the light weight, the workability, and the less expensiveness and that an alloy of nickel and phosphorus is preferred as the material of the alloy layer 13. That surface of the disk 12 on which the alloy layer 13 is plated, is given a flat topography by turning and heat-flattening processes. The tolerance of the flatness is 50 microns in the azimuthal or circumferential direction and 10 microns in the radial direction. The alloy layer 13 should have an external surface highly polished, by mechanical polishing, to a mirror surface of the surface roughness less than 0.04 micron. The thickness of the alloy layer 13 may be 30 microns. The substrate 11 may consist of the alloy disk 12 alone, in which case a surface of the alloy disk 12 should be polished to the mirror surface. The material preferred for such an alloy disk 12 is titanium.

A thin film 15 of a magnetic material of the properties pointed out hereinabove, is formed on the highly polished surface of the substrate 11 in direct contact therewith. Inasmuch as the magnetic material is usually a metal or an alloy, it is possible to resort to plating on forming the magnetic metal film 15. It is usual to plate an alloy of cobalt, nickel, and phosphorus to a thickness of about 0.05 micron to form the magnetic metal film 15.

According to the above-cited United States patent, a primary solution is prepared by dissolving tetrahydroxysilane in ethyl alcohol to a concentration of 11% by weight. A secondary solution is prepared by dissolving the primary solution in normal butyl alcohol to a concentration of 20% by weight. A layer of the resultant solution is formed directly on the magnetic metal film 15. A spin coating process is preferred on forming the layer of solution. More particularly, the substrate 11 on which the magnetic metal film 15 is formed, is rotated at a speed of about 200 r.p.m. (revolutions per minute) with the exposed surface of the magnetic metal film 15 held horizontal and directed upwards. The resultant solution is discharged from its vessel to the top surface of the magnetic metal film 15 adjacent to the axis of rotation. The discharged solution spreads over the top surface towards its outer circumference due to the centrifugal force.

As described in the patent being referred to, the layer of solution is treated into a polysilicate layer 16 (FIGS. 2 and 3). The polysilicate layer 16 includes silanol radicals as described hereinabove. The polysilicate layer 16 should have a thickness selected between 0.1 micron and 0.3 micron. Inasmuch as the thickness of the layer of solution decreases by about 20% during the treatment, an amount of the discharged solution should be adjusted so as to provide the polysilicate layer 16 of the desired thickness. At the beginning of treatment, the layer of solution may or may not be left as spread over the magnetic metal film 15 for a short while, such as five minutes, so as to allow the solvent or solvents to evaporate at least to a certain degree.

In accordance with the process according to this invention, the treatment is carried out by pre-baking the layer of solution at first into a pre-baked layer 16' and then irradiating the pre-baked layer 16' by a laser beam 17 to provide the polysilicate layer 16. Pre-baking may be carried out at a temperature in the above-exemplified range for a shorter while than those described hereinabove. Typically, an assembly comprising the non-magnetic substrate 11, the magnetic metal film 15, and the layer of solution, is placed in an electric furnace and heated at 200° C. for only one hour. The atmosphere in which the layer of solution is thus pre-baked is not critical. The magnetic properties of the substrate 11 and the film 15 are not varied to adversely affect the recording and the reproducing characteristics of the film 15.

In view of the spectral absorbing characteristics of the polysilicate and the spectral reflecting characteristics of the magnetic metal film 15, the laser beam 17 should have a wavelength between 4 microns and 50 microns and, more preferably, between 9 microns and 11 microns. In view of the infrared absorption of the silanol radicals at the above-mentioned wavelength of 10.6 microns, a carbon dioxide laser beam, having a wavelength of 10.6 microns, is the most preferred. The diameter of the laser beam 17 may be about 10 mm on the pre-baked layer 16'. As will later be described, the diameter may be as small as 0.1 mm. The laser beam 17 is depicted in FIG. 1 merely by a line for simplicity of illustration. The angle of incidence is immaterial. The pre-baked layer 16' may be irradiated by such a laser beam 17 either immediately after the pre-baked assembly is taken out of the electric furnace or after the same is allowed to cool down. While being irradiated, the assembly is rotated about the disk center and moved radially relative to the laser beam 17. The pre-baked layer 16' is thereby turned into the polysilicate layer 16. When a carbon dioxide gas laser tube was continuously driven to generate a laser beam 17, 10 mm in diameter, with an output power of 250 watts, the pre-baked layer 16' having a thickness of 0.1 micron was treated into the desired polysilicate layer 16 with the assembly rotated at a speed of 2 r.p.m.

Turning to FIG. 2, it is possible to form a silicon containing lubricant film 19 directly on the polysilicate layer 16 with the silicon containing lubricant oriented so as to adhere to the polysilicate layer 16. Preferably, the thickness of the film 19 should be less than about 0.02 micron. The oriented lubricant film 19 tenaciously adheres to the polysilicate layer 16 to reduce the friction between the head and the magnetic record member. Together with examples of the lubricants, such advantages of the film 19 are described in detail in U.S. Pat. No. 4,069,360 issued to Masahiro Yanagisawa, the present applicant, et al, assignors to the present assignee.

Examples of the tetrahydroxysilane solutions are described in detail in U.S. patent application Ser. No. 102,731 filed Dec. 12, 1979, by the present applicant for assignment to the instant assignee. For convenience of the description that follows for a short while, let those solutions be called solutions of a first kind, in which solvents have a boiling point between 70° C. and 100° C. Examples of such solvents are methyl alcohol, ethyl alcohol, normal propyl alcohol, isopropyl alcohol, secondary butyl alcohol, tertiary butyl alcohol, methyl acetate, ethyl acetate, isopropyl acetate, methyl propionate, acetone, ethyl methyl ketone, and isopropyl methyl ketone. Those solution will be named solutions of a second kind, in which the solvents have a boiling point higher than 100° C. A typical examle of the solvents is normal butyl alcohol having a boiling point at 118° C.

Solutions of the first kind may be prepared by dissolving tetrahydroxysilane in isopropyl alcohol to a concentration of 11% by weight and then by dissolving the primary solution again in isopropyl alcohol to a concentration of 14% by weight, by dissolving tetrahydroxysilane in ethyl alcohol to 11% and then by dissolving the primary solution again in ethyl alcohol to 14%, by dissolving tetrahydroxysilane in ethyl alcohol to 5.6% and by dissolving the primary solution in secondary butyl alcohol to 27%, by dissolving tetrahydroxysilane in methyl alcohol to 5.6% and by dissolving the primary solution in ethyl alcohol to 27%, by dissolving tetrahydroxysilane in isopropyl alcohol to 5.6% by dissolving the primary solution in acetone to 27%, and by dissolving tetrahydroxysilane in isopropyl alcohol to 5.6% and then by dissolving the primary solution again in isopropyl alcohol to 27%. A solution of the second kind may be prepared by dissolving tetrahydroxysilane in normal butyl alcohol to 5.6% and then by dissolving the primary solution again in normal butyl alcohol to 27%. It is possible to directly dissolve tetrabydroxysilane in a solvent to the desired concentration when the same solvent is used in common to the primary and the secondary solutions.

Turning further to FIG. 3, the polysilicate layer 16 has a surface roughness between 0.02 micron and 0.05 micron with sinusoidal undulations extended transversely of the tracks with a pitch in a range between 10 microns and 200 microns along the inner circumference of the magnetic metal film 15 when the spin coating process is carried out by the use of any one of the first-kind solutions with the speed of rotation selected between 50 r.p.m. and 200 r.p.m. As discussed in detail in the patent application being referred to, the undulations are effective in reducing adhesiveness between the head and the magnetic record member. When the second-kind solution is used, the surface roughness does not exceed 0.02 micron. Incidentally, the magnetic metal film 15 of a magnetic disk, usually called a 14-inch disk, has an outer and an inner circumference spaced 178 mm and 84 mm from the center of the disk.

Referring now to FIG. 4, a magnetic disk is manufactured in accordance with a process according to a second embodiment of this invention. As described with reference to FIG. 1, a non-magnetic substrate 11 is plated with a magnetic metal film 15. A reflective layer 21 is formed on the film 15 in direct contact therewith. The reflective layer 21 should be capable of reflecting infrared rays having wavelengths at least between 9 microns and 11 microns. The reflective layer 21 may be a silver, a gold, or a copper layer and preferably has a thickness less than about 0.05 micron. Inasmuch as it is possible to do without the reflective layer 21, the lower limit of the thickness is zero. Electroplating is preferred because it is thereby readily possible to control the thickness. The polysilicate layer 16 is formed directly on the reflective layer 21 by the use of the laser beam 17.

Referring to FIG. 5, a pair of magnetic disks is simultaneously manufactured in accordance with a process according to a third embodiment of this invention. For this purpose, a first half-finished magnetic disk 26 is manufactured as described with reference to either of FIGS. 1 and 4 except for the laser beam irradiating step. A second half-finished magnetic disk 27 is likewise manufactured. The first and the second half-finished magnetic disks 26 and 27 are disposed substantially parallel, with the pre-baked layers 16' and 16' thereof brought into face to face relation and with the outer circumferential edge of the first half-finished magnetic disk 26 extended beyond the outer circumferential edge of the second half-finished magnetic disk 27.

The laser beam 17 is caused to be incident on the pre-baked layer 16' of the first half-finished magnetic disk 26 adjacent to the outer circumferential edge thereof with an angle of incidence of as, for example, 45° such that the laser beam 17 is repeatedly reflected by the magnetic metal films 15 and/or the reflective layers 21. When the diameter of the laser beam 17 on the pre-baked layer 16' is 10 mm, it is preferred that the distance between the pre-baked layers 16' of the magnetic disk 26 and 27 be about 10 mm so that the successively reflected laser beam will cover the pre-baked layers 16' continuously along the radii of the disks 26 and 27. It should be understood here that the laser beam 17 is repeatedly reflected by the magnetic metal film 15 when the half-finished magnetic disk 26 and 27 does not comprise the reflective layer 21 and that the laser beam 17 is primarily reflected by the reflective layer 21 if there is. Only one of the half-finished magnetic disks 26 and 27 may comprise the reflective layer 21.

It has been confirmed even with a pair of half-finished magnetic disks 26 and 27 having no refective layer 21 that the laser beam 17 is capable of treating the pre-baked layers 16' into the polysilicate layers 16 even after reflected a few scores of times. This makes it possible to manufacture a magnetic disk of a diameter greater than 35 cm without radially moving the same relative to the laser beam 17.

Referring to FIG. 6, a magnetic disk is manufactured in accordance with a process according to a fourth embodiment of this invention. For this purpose, a half-finished magnetic disk 26 is manufactured as described in conjunction with either of FIGS. 1 and 4 except for the laser beam irradiating step. A reflector 28 having a planar surface capable of reflecting the laser beam 17 and having an edge 29 is disposed substantially parallel to the half-finished magnetic disk 26 with the planar surface brought into face to face relation to the pre-baked layer 16' of the half-finished magnetic disk 26 and with the outer circumferential edge of the half-finished magnetic disk 26 extended beyond the reflector edge 29. The reflector 28 may be a copper plate or a glass plate having a mirror surface plated with silver or gold.

The laser beam 17 is caused to be incident on the pre-baked layer 16' of the half-finished magnetic disk 26 adjacent to the outer circumferential edge thereof with an angle of incidence such that the laser beam 17 is repeatedly reflected by the reflector 28 and either the magnetic metal film 15 or the reflective layer 21. Inasmuch as the laser beam 17 is absorbed by the pre-baked layer 16' of only one half-finished magnetic disk 26, the laser beam 17 is capable of treating the pre-baked layer 16' into the desired polysilicate layer 16 even after reflected nearly twice as many times as that described in connection with FIG. 5. This makes it possible to use a laser beam 17 of a small cross-sectional diameter to raise the energy density.

Figure 7:
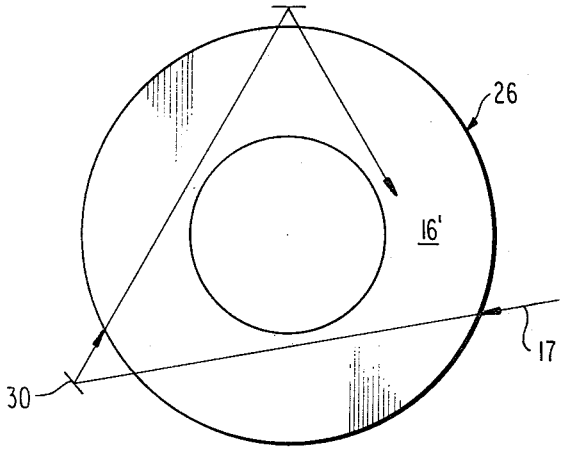
FIG. 7 is a top view of a magnetic disk being irradiated by a laser beam in accordance with a modification of the process illustrated in FIG. 5 or 6.

Turning to FIG. 7, only one half-finished magnetic disk 26 being manufactured according to the process illustrated with reference to either of FIGS. 5 and 6, is depicted with the second half-finished magnetic disk 27 or the reflector 28 removed for clarity of illustration. The laser beam 17 is caused to be incident on the half-finished magnetic disk 26 with an acute angle formed relative to a radius of the disk 26. A plurality of mirrors, exemplified at 30, are disposed to make effective use of the laser beam 17 being repeatedly reflected by the magnetic metal films 15 and/or the reflective layers 21 of the disks 26 and 27 or by the magnetic metal film 15 or the reflective layer 21 of the disk 26 and the reflector 28. When the laser beam 17 being repeatedly reflected tends to diverge, each mirror, such as 30, is preferably a concave mirror.

Figure 8:
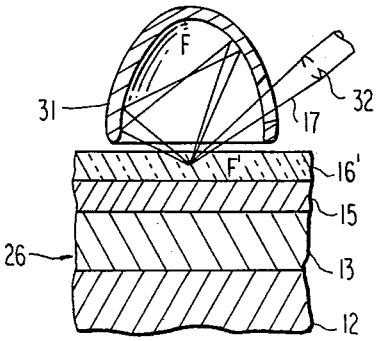
FIG. 8 is a schematic radial sectional view of a portion of a magnetic disk for use in describing a process according to a fifth embodiment of this invention.

Referring to FIG. 8, a magnetic disk is manufactured in accordance with a process according to a fifth embodiment of this invention. For this purpose, a half-finished magnetic disk 26 is manufactured as described with reference to either of FIGS. 1 and 4 except for the laser beam irradiating step. A light collector for the laser beam 17 is used on irradiating the pre-baked layer 16' of the half-finished magnetic disk 26. The light collector is for making the laser beam 17 converge at a predetermined area, such as 0.1 mm in diameter, and is disposed so as to place the predetermined area within the pre-baked layer 16'.

Referring more specifically to FIG. 8, the light collector comprises a reflector 31 having an inwardly directed surface which is given by partly cutting a spheroidal surface away with a first focus F of the spheroidal surface positioned inwardly of the inwardly directed surface and which is capable of reflecting the laser beam 17. A condenser 32 is held by a holder (not shown) relative to the half-finished magnetic disk 26 so as to condense the laser beam 17 at the predetermined area. The condenser 32 may be a lens made of a material transparent to the laser beam 17. Besides the well-known sodium chloride and potassium bromide lenses, a lens made of either germanium or zinc selenide is available on the market for use in condensing the laser beam 17.

The reflector 31 is held relative to the half-finished magnetic disk 26 so as to be disposed in such a manner that a second focus F' of the spheroidal surface is placed substantially at the predetermined area. The major axis of the spheroidal surface is directed approximately perpendicular to the pre-baked layer 16'. It is now understood that the condenser 32 is disposed so that the second focus F' is substantially covered by the predetermined area. In the figure, the thicknesses of the films and the layers of the half-finished magnetic disk 26 is much exaggerated as compared with the light collector. As described, the pre-baked layer 16' is only about 0.1 to 0.3 micron thick. It is therefore possible to understand that the predetermined area is substantially on the magnetic metal film 15 or the reflective layer 21.

That portion of the laser beam 17 which is not absorbed by the pre-baked layer 16', is reflected by either of the magnetic metal film 15 and the reflective layer 21. The reflected portion is reflected by the reflector 31 to converge at the first focus F and then diverge towards the reflective surface of the reflector 31. The divergent beam is again reflected by the reflector 31 to converge at the second focus F', namely, at the predetermined area.

It is possible to insure repeated reflection of the laser beam 17 by the reflector 31 and by the magnetic metal film 15 or the reflective layer 21, by disposing the reflector 31 so that the major axis forms an acute angle with the plane of incidence of the laser beam 17 onto the pre-baked layer 16' through the condenser 32. The acute angle is preferably of the order of an angle of the aperture into which the laser beam 17 is condensed by the condenser 32. Most preferably, the acute angle is from twice to three times as great as the angle of aperture.

Figure 9:
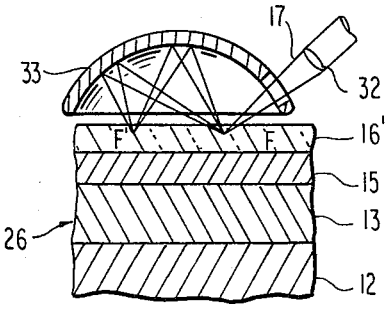
FIG. 9 is a schematic radial sectional view of a portion of a magnetic disk for use in describing a process according to a sixth embodiment of this invention.

Referring finally to FIG. 9, a magnetic disk is manufactured in accordance with a sixth embodiment of this invention by the use of a light collector as in the process described with reference to FIG. 8. The light collector comprises the condenser 32 and a reflector 33 having an inwardly directed surface which is given by partly cutting a spheroidal surface away with the major axis of the spheroidal surface positioned outwardly of the inwardly directed surface and which is capable of reflecting the laser beam 17. The reflector 33 is disposed so that two foci F and F' of the spheroidal surface are placed within the pre-baked layer 16', with the major axis extended substantially on the plane of incidence of the laser beam 17 onto the pre-baked layer 16' through the condenser 32.

That portion of the laser beam 17 condensed by the condenser 32 at the first focus F which is not absorbed by the pre-baked layer 16', is reflected towards the reflector 33 by either of the magnetic metal film 15 and the reflective layer 21 and is focussed at the second focus F'. The beam portion reflected at the second focus F' by the magnetic metal film 15 or the reflective layer 21 is again focussed at the first focus F. Reflection is thus repeated. It is possible to simultaneously treat two portions of the pre-baked layer 16'.

Several examples of the process according to this invention will now be described. For use as a reference, an example of the process by which a magnetic disk described in U.S. Pat. No. 4,162,350 referred to hereinabove is manufactured, will also be described.

EXAMPLE 1

A magnetic disk was manufactured as herein described with reference to FIG. 1. The non-magnetic alloy disk 12 was made of an aluminum alloy known in the art. The surface on which the non-magnetic alloy layer 12 should be formed, was finished to have a flat topography mentioned hereinabove. As the layer 13, a known alloy of nickel and phosphorus was plated on the finished surface of the alloy disk 12 to a thickness of about 50 microns and was polished to a thickness of about 30 microns with the surface roughness less than 0.02 micron. The known alloy of cobalt, nickel, and phosphorus was plated on the mirror finished surface to a thickness of 0.05 micron. A 2% solution of tetrahydroxysilane in normal butyl alcohol was applied on the magnetic metal film 15 to a thickness a little thicker than 0.1 micron. The percentage is by weight throughout the examples. After pre-baked at 200° C. for only one hour, the pre-baked layer 16' was irradiated by a laser beam 17 generated by a continuously excited carbon dioxide gas laser tube with the output power of 250 watts. The laser beam 17 was caused to irradiate the pre-baked layer 16' at an area of 10 mm in diameter and at an angle of incidence of 45°. The half-finished magnetic disk was rotated at a speed of 2 r.p.m. and moved radially relative to the area irradiated by the laser beam 17. The pre-baked layer 16' of a magnetic disk having an outer diameter of 35.6 cm and comprising a magnetic metal film 15, 16.8 cm in inner diameter, was turned into the desired polysilicate layer 16 by the irradiation of an overall time of 4.5 minutes.

EXAMPLE 2

A magnetic disk was manufactured as described in Example 1 except that the process illustrated with reference to FIG. 4 was resorted to. The reflective layer 21 was formed of silver to a thickness of 0.05 micron. The solution was a 2% solution of tetrahydroxysilane in isopropyl alcohol. The overall irradiation time was 1.5 minutes.

EXAMPLE 3

A pair of magnetic disks was manufactured as described in Example 1 except that the process illustrated with reference to FIG. 7 was resorted to. The half-finished magnetic disks 26 and 27 comprising no reflective layers, such as 21, were disposed parallel at a spacing of 10 mm. The laser beam 17 was repeatedly reflected thirty times. The overall time of irradiation was 0.75 minute.

EXAMPLE 4

A magnetic disk was manufactured like in Example 1 except that the process illustrated with reference to FIG. 7 was resorted to by the use of the reflector 28. The laser beam 17 was reflected sixty times. The overall time of irradiation was 0.75 minute.

EXAMPLE 5

A magnetic disk was manufactured like in Example 1 except that the process described in conjunction with FIG. 8 was resorted to. The predetermined area was 0.1 mm in diameter. The overall time of irradiation was 1.5 minutes.

EXAMPLE 6

A magnetic disk was manufactured like in Example 1 except that the process resorted to was that described with reference to FIG. 9. The overall time of irradiation was 1.5 minutes.

Reference

A magnetic disk was manufactured as in Example 1 except that the baking step was continued at 200° C. for three hours without irradiating the baked layer to a laser beam at all.

Scratch tests were carried out for the magnetic disks manufactured by the processes described in Examples 1 through 6 and Reference by the use of a sapphire needle having a tip radius of 0.03 mm. A scratch was observed on the polysilicate layer of the disk manufactured as described in Reference when the load was 20 grams. No scratches were observed on the polysilicate layers 16 of the magnetic disks manufactured as described in Examples 1 through 6 up to a load of 80 grams.

CSS test cycles were repeated thirty thousand times as described in U.S. Pat. No. 4,162,350 cited hereinabove except that the head load was rendered more severe by increasing the load to 50 grams from the load of 10 grams used in the tests described in the United States patent. No scratches were observed on the polysilicate layers 16 manufactured as described in Examples 1 through 6. A scratch appeared on the polysilicate layer of the disk manufactured as described in Reference when the test cycles were repeated only a thousand times.

While several embodiments of a process according to this invention have thus far been described in specific conjunction with magnetic disks together with modifications thereof, it will now be obvious to those skilled in the art that this invention can be put into effect in various other ways. Above all, the processes exemplified above are readily applicable to manufacture of magnetic drums when the curvature of the magnetic metal film 15 or the reflective layer 21 is taken into consideration. More specifically, it is preferred on resorting to the process illustrated with reference to any one of FIGS. 5 through 7 to use a cylindrical condenser on irradiating the pre-baked layer 16' or layers so as to prevent the reflected laser beam from considerably diverging. For the process described with reference to FIG. 6, it is possible to use a concave cylindrical reflector 28 for the like purpose. This applies to the case where the process described with reference to FIG. 8 or 9 is resorted to. The mirrors, such as 30, used in the process described in connection with FIG. 7 should repeatedly reflect the laser beam 17 substantially parallel to the axis of the drum, with the drum rotated about its axis at a higher speed.

What is claimed is:

1. In a process for manufacturing a magnetic record member comprising the steps of preparing a substrate of at least one non-magnetic metal material, forming a film of a magnetic material on said substrate in direct contact therewith, forming a layer of a solution of tetrahydroxysilane on said film, and treating said layer of solution into a layer of polysilicate, said magnetic material being capable of retaining magnetization as records of electrical signals in said film for reproduction of said electrical signals, the improvement wherein said treating step comprises the steps of:

pre-baking said layer of solution at a temperature in the range of 100 to 300 degrees centigrade to provide a pre-baked layer in a manner such that the magnetic properties of said substrate and said film are not varied to adversely affect the recording and the reproducing characteristics of said film; and irradiating said pre-baked layer with a carbon dioxide laser beam to provide said polysilicate layer, said laser beam having a wavelength between 4 microns and 50 microns.

2. A process as claimed in claim 1, wherein said laser beam has a wavelength between 9 microns and 11 microns.

3. A process as claimed in claim 2, wherein said layer forming step is carried out to form said layer of solution directly on said film of magnetic material, said film of magnetic material being capable of reflecting said laser beam.

4. A process as claimed in claim 2, further comprising the step of forming a reflective layer directly on said film of magnetic material, said reflective layer being capable of reflecting said laser beam, said solution layer forming step being carried out to form said layer of solution directly on said reflective layer.

5. A process as claimed in claim 4, wherein said reflective layer forming step is carried out by depositing silver, gold, or copper directly on said film of magnetic material to a thickness less than about 0.05 micron.

6. A process as claimed in claim 3, wherein said film of magnetic material is an alloy of cobalt, nickel and phosphorous.

7. A process as claimed in claims 3 or 4, wherein said irradiating step comprises the steps of:

disposing a first half-finished magnetic record member manufactured through said substrate preparing step and the following steps except for said irradiating step to make said first half-finished magnetic record member have an edge transversely of the film of magnetic material and the pre-baked layer of said first half-finished magnetic record member, substantially parallel to a second half-finished magnetic record member manufactured through said substrate preparing step and the following steps except for said irradiating step to make said second half-finished magnetic record member have an edge transversely of the film of magnetic material and the pre-baked layer of said second half-finished magnetic record member, with the pre-baked layers of said first and said second half-finished magnetic record members brought into face to face relation and with the edge of one of said first and said second half-finished magnetic record members extended beyond the edge of the other of said first and said second half-finished magnetic record members; and causing said laser beam to be incident on the pre-baked layer of said other of first and second half-finished magnetic record members with an angle of incidence such that said laser beam is repeatedly reflected to thereby irradiate the pre-baked layers of said first and said second half-finished magnetic record members by said laser beam.

8. A process as claimed in claims 3 or 4, wherein said irradiating step comprises the steps of:

disposing a reflector having a surface capable of reflecting said laser beam and having an edge, substantially parallel to a half-finished magnetic record member manufactured through said substrate preparing step and the following steps except for said irradiating step to make said half-finished magnetic record member have an edge, with the surface of said reflector and the pre-baked layer of said half-finished magnetic record member brought into face to face relation and with the edge of said half-finished magnetic record member extended beyond the edge of said reflector; and causing said laser beam to be incident on the pre-baked layer of said half-finished magnetic record member with an angle of incidence such that said laser beam is repeatedly reflected.

9. A process as claimed in claims 3 or 4, wherein said irradiating step comprises the steps of:

disposing a light collector for making said laser beam converge at a predetermined area, so as to place said predetermined area substantially within the pre-baked layer of a half-finished magnetic record member manufactured through said substrate preparing step and the following steps except for said irradiating step; and causing said light collector to converge said laser beam at said predetermined area.

10. A process as claimed in claim 9, wherein said light collector comprises:

a reflector having an inwardly directed surface which is given by partly cutting a spheroidal surface away with one of two foci of said spheroidal surface positioned inwardly of said inwardly directed surface and is capable of reflecting said laser beam; and a condenser for condensing said laser beam at said predetermined area;

said irradiating step being carried out by:

disposing said reflector so that the other of said foci is placed substantially within the pre-baked layer of said half-finished magnetic record member;

disposing said condenser so that said other focus is substantially covered by said predetermined area; and causing said laser beam to be incident on the pre-baked layer of said half-finished magnetic record member through said condenser, whereby said laser beam is reflected, towards said inwardly directed surface to be again directed to said predetermined area after twice reflected by said inwardly directed surface.

11. A process as claimed in claim 10, wherein said reflector is disposed so that a major axis of said spheroidal surface forms an acute angle with the plane of incidence of said laser beam onto the relevant one of said film of magnetic material and said reflective layer through said condenser.

12. A process as claimed in claim 9, wherein said light collector comprises:

a reflector having an inwardly directed surface which is given by partly cutting a spheroidal surface away with a major axis of said spheroidal surface positioned outwardly of said inwardly directed surface and is capable of reflecting said laser beam; and a condenser for condensing said laser beam at said predetermined area;

said irradiating step being carried out by causing said laser beam to be incident onto the pre-baked layer of said half-finished magnetic record member through said condenser, with said condenser disposed so that said predetermined area is placed substantially within the pre-baked layer of said half-finished magnetic record member and with said reflector disposed so that said major axis extends on the plane of incidence of said laser beam onto the pre-baked layer of said half-finished magnetic record member and substantially within the pre-baked layer of said half-finished magnetic record member.

13. A process as claimed in claim 1 wherein said pre-baking step is carried out at a temperature of 200° C. for one hour.

* * * * *

UNITED STATES PATENT AND TRADEMARK OFFICE

CERTIFICATE OF CORRECTION

PATENT NO. : 4,380,558

DATED : April 19, 1983

INVENTOR(S) : Masahiro YANAGISAWA

It is certified that error appears in the above—identified patent and that said Letters Patent is hereby corrected as shown below:

Column 6, line 8, after "Those" correct the spelling of "solutions".

Column 6, line 10, after "typical", correct the spelling of "example".

Column 6, lines 33-34, correct the spelling of "tetrahydroxysilane".

Column 7, line 37, before "layer", correct the spelling of "reflective".

Signed and Sealed this

Second Day of August 1983

[SEAL]

Attest:

GERALD J. MOSSINGHOFF

Attesting Officer

Commissioner of Patents and Trademarks